US006291150B1

(12) United States Patent
Camp et al.

(10) Patent No.: US 6,291,150 B1
(45) Date of Patent: Sep. 18, 2001

(54) REFLECTIVE PHOTOGRAPHIC MATERIAL WITH FOIL LAYER

(75) Inventors: Alphonse D. Camp, Rochester; Robert P. Bourdelais, Pittsford; Peter T. Aylward, Hilton, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/217,052

(22) Filed: Dec. 21, 1998

(51) Int. Cl.[7] ..... G03C 1/76

(52) U.S. Cl. ..... 430/524; 430/525; 430/526; 430/536; 430/538

(58) Field of Search ..... 430/524, 525, 430/526, 536, 538

(56) References Cited

U.S. PATENT DOCUMENTS

| | | | | |
|---|---|---|---|---|
| 4,317,122 | * | 2/1982 | Namiki et al. | 430/524 |
| 4,317,123 | * | 2/1982 | Namiki et al. | 430/524 |
| 4,701,369 | | 10/1987 | Duncan . | |
| 4,701,370 | | 10/1987 | Park . | |
| 4,948,719 | * | 8/1990 | Koike et al. | 430/524 |
| 5,084,334 | | 1/1992 | Hamano et al. . | |
| 5,139,870 | * | 8/1992 | Koike et al. | 428/314 |
| 5,141,685 | | 8/1992 | Maier et al. . | |
| 5,143,765 | | 9/1992 | Maier et al. . | |
| 5,223,383 | | 6/1993 | Maier et al. . | |
| 5,275,854 | | 1/1994 | Maier et al. . | |
| 5,422,175 | | 6/1995 | Ito et al. . | |
| 5,853,965 | | 12/1998 | Haydock et al. . | |
| 5,866,252 | * | 2/1999 | Bourdelais et al. | 430/22 |
| 5,866,282 | * | 2/1999 | Burdelais et al. | 430/22 |
| 5,874,205 | | 2/1999 | Bourdelais et al. . | |
| 5,945,266 | * | 8/1999 | Maskasky | 430/524 |

FOREIGN PATENT DOCUMENTS

| | | |
|---|---|---|
| 25 02 878 | 7/1976 | (DE) . |
| 38 38 704 A1 | 6/1989 | (DE) . |
| 40 18 138 A1 | 1/1991 | (DE) . |
| 0 470 760 A2 | 2/1992 | (EP) . |
| 0 880 065 A1 | 11/1998 | (EP) . |
| 0 880 067 A1 | 11/1998 | (EP) . |
| 0 880 069 A1 | 11/1998 | (EP) . |
| 901163 | 7/1959 | (GB) . |
| 2 215 268 B | 9/1989 | (GB) . |
| 2 325 749 A | 12/1998 | (GB) . |
| 2 325 750 A | 12/1998 | (GB) . |
| 2 333 607 A | 12/1998 | (GB) . |
| 61-210346 | 9/1986 | (JP) . |

OTHER PUBLICATIONS

Japanese Abstract 85/31669 w/claims no date.
Japanese Abstract 5,057,836, 1993 no date.
Japanese Abstract 7,137,216, 1995 w/claim no date.

* cited by examiner

*Primary Examiner*—Janet Baxter
*Assistant Examiner*—Amanda C. Walke
(74) *Attorney, Agent, or Firm*—Paul A. Leipold

(57) ABSTRACT

This invention relates to a photographic element comprising at least one silver halide containing imaging layer and a metallic layer below said at least one imaging layer having a having a highly spectral reflectance.

59 Claims, No Drawings

REFLECTIVE PHOTOGRAPHIC MATERIAL WITH FOIL LAYER

FIELD OF THE INVENTION

This invention relates to the formation of a laminated substrate containing metallic reflective layers for photographic materials. It particularly relates to improved substrates for photographic imaging.

BACKGROUND OF THE INVENTION

In the formation of color paper it is known that the base paper has applied thereto a layer of polymer, typically polyethylene. This layer serves to provide waterproofing to the paper, as well as providing a smooth surface on which the photosensitive layers are formed. Photographic print papers traditionally require materials such as a white pigmented polymer layer attached to a cellulose paper support. These materials provide a white appearing surface and spectrally diffuse layer that provides a pleasing surface for viewing. The polymer layer under the photographic layer also contains TiO2 to provide enhanced sharpness, opacity and whiteness. When images are displayed for advertising and other commercial uses, it is very important to have a print display that is very unique and eye catching.

While conventional photographic images on resin coated paper are high in quality for some attributes, they are very flat appearing and lack depth of image. It is very desirable to have objects within an image to appear as though they have depth of image. That is, they appear as though they are higher than the background. This appearance provides a very pleasing appearance to the image and significant commercial value. With conventional resin coated photographic paper, the customer or photofinisher will often write or record information on the backside of a photographic print. The opacity of current photographic paper provides only a limited amount of shielding to prevent show through when viewing prints. Usually the density of anything on the backside must be very light in color to prevent the viewer it through the print.

PROBLEM TO BE SOLVED BY THE INVENTION

There remains a need to provide an imaging support with highly reflective surfaces under the image to create greater depth of image when reviewing an image.

SUMMARY OF THE INVENTION

It is an object of the invention to provide improved imaging materials.

It is another object to provide opaque imaging support.

It is a further object to provide imaging supports that have added depth of image.

It is an additional object to provide imaging supports that have a unique appearance.

These and other objects of the invention generally are accomplished by a photographic element comprising at least one metallic layer.

ADVANTAGEOUS EFFECT OF THE INVENTION

The invention provides an improved base for photosensitive layers and other image receiving layers. It particularly provides an improved base for color photographic materials that require high depth of image for viewing. The advantage of this invention is that by providing a highly reflective layer under the image and also providing a clear space or separation between the image and highly reflective surface, there is a tremendous depth of image that is created. The image that is created provides a near three dimensional effect and very eye catching appeal It various display applications or advertising, this type of image attracts a lot of attention which is necessary to sell the products being advertised. The effect provides a very unique imaging element that has applications in sport cards, post cards, reflective or mirror like sticker prints, large advertising displays as well as consumer prints. In addition, the higher opacity that is achieved will allow much higher density backprinting without show through when viewing the image.

DETAILED DESCRIPTION OF THE INVENTION

The invention has numerous advantages over prior practices in the art. Enhancements and commercial value are realized by providing photographic supports that have highly reflective surfaces under the image layer. By placing a highly reflective metallic layer under a photographic image and separating it by a clear polymer layer, there is added depth to the image. In some cases this creates a near three dimensional effect. This type of image has significant commercial value. Even the uniqueness of a highly reflective layer in an imaging element, provides economic value to the print material When an image is created or placed on a substantially clear substrate and the image is then placed a short distance from a highly reflective surface such as a high gloss metallic layer, a secondary image is generated. When an observer views such an image from an angle, a perception of depth of image is generated. Such an image is very eye catching and has significant value when compared to conventional two dimensional images. The present invention consists of a multilayer film of biaxially oriented polymer and in particular polyolefin. Other polymers such as polyester, polyamides with a highly reflective metallic layer may be used. In this invention the photographic element comprises at least one metallic layer and further comprises a support substrate. Since the invention incorporates a highly reflective mirror like surface, it is important to have a substrate that is very flat and planar below the reflective layer. To achieve the desired appearance it is desirable to have a substrate that comprises a polymer sheet. Polymer sheets that have been cast on a smooth surface and then oriented in general provides a much smoother surface and when viewed creates an unique appearance to the print. Traditional cellulose paper substrates that are manufactured on a paper machine tend to have various roughness patterns associated with their formation. These non-uniformities can create stray light reflections when associated with high reflective materials. This creates an undesirable appearance to the image. In is known in the art that coated papers may provide smoother appearance that will help reduce the paper non uniformity's. These are generally pigments that have been mixed with a binder and then applied to the paper base stock. The application of these and other materials may be by any techniques known in the art of coated substrates. These include blade, rod, roller, cast, air knife, spray, vacuum or plasma deposition or even lamination of layers to paper, or combination of these and other techniques. Such preparation of paper does eliminate many of the objectionable non-uniformity. Even coating the paper with a melt extruable layer of sufficient coverage may also be used to improve the nonuniforimites of the paper. In the case when it is desirable to have a highly reflective image with some depth associated to it the reflective metallic layer is located between the support and the image forming layer. By placing a clear polymer layer between the image and the reflective layer, even greater depth of reflection is achieved. In the case when the need is to improve the opacity of the imaging substrate, the metallic layer may have less gloss and an intermediate layer of white opaque material is placed between the metallic layer and the image. While this technique will reduce the metallic appearance of the print, it may be more desirable to place the opaque layer on the bottom side of the base substrate. This method takes advantage of the added opacity of the raw stock to minimize the dark color associated with many metallic layers. It is know in the art of foil and metallic layers that a white foil or over coat of a white pigment coating or ink, will further minimize the gray show through of a metallic layer. The biaxially oriented films that have been used in this invention contain a plurality of layers in which at least one of the layers contains voids of sufficient thickness to minimize the dark color appearance imparted by the metallic layer. The voided layer may be further enhanced by the addition of an opacifing pigment, tint or optical brightener that is added to the voided layer or in a separate layer of a multi layer structure. The metallic layer may be vacuum deposited onto a polymer sheet or comprise of a metal foil These materials may further comprise cellulose paper. The paper adds strength, rigidity and other favorable attributes to the structure.

In a preferred embodiment of this invention said metallic layer is located between the photosensitive silver halide emulsion and the support. The purpose of locating the metallic layer between the emulsion and support is that it provides some very unique optical properties to the final print which in certain market segments are desirable. The reflective qualities provide a very soft fuzzy appearing image which is desirable in the certain fine art applications. Furthermore the additional of a metallic layer also provides a means to prevent gases and other materials from moving between the support and the sensitive image layer. The exchange and movement of these chemicals may have a negative impact on the image resulting in a significant loss in commercial value or appeal to the customer.

In addition if a clear layer or substantially transparent layer is placed between the highly reflective metallic layer and at least one photosensitive layer silver halide layer, a unique structure that has a very deep depth of image. The depth of image that is provided by this structure is several orders better than a conventional photographic glossy print which appears very flat. This element has tremendous commercial value. When the thickness of the substantially transparent layer is increased the relative depth of image is increased which provides a very deep, rich appearing print that is unique in the photographic area. In the preferred embodiment said transparent layer has a thickness between 10–250 micrometers. While even larger thickness are possible and they provide even greater depth of image or near three dimensional appearance, the overall photographic element thickness start to create some photofinishing and handling concerns. The metallic layer should have a reflectance greater than 85% of the visible spectrum of light and furthermore it should be spectral as opposed to diffusive. The metallic surface should be very flat and free of roughness, especially the high frequency microscopic features which tend to reflect light in a random pattern which cuts down on the highly desirable mirror like appearance of a smooth flat surface. In a photographic element comprising a highly reflective metallic surface, it is desirable to have the metallic surface of sufficient smoothness such that the light is reflected spectrally. Spectral light reflection is such that the reflected light rays are parallel or have a more orderly arrangement to the rays than a random diffusive reflection of rays associated with a rough surface.

There is also a need to have a photographic element comprising a metallic layer in which there is a diffusive layer between the silver halide emulsion and the metallic layer. The diffusive layer may be a layer of pigment dispersed in a polymer, a polymer layer comprising voids or a combination of pigments and voids. This layer may also be tinted to offset or mast the dark appearance of the metallic layer. In this case these layers are generally used to provide a photographic element that has a more traditional appearance of a white background. The metallic layer may also be overprinted or coated with a white ink or other coating to further minimize any show through of the dark appearing metalic. The metallic layer adds a large component of opacity to the photographic element. This would enable the use of more bold appearing backprint or induce, magnetic layers . . . etc. The white diffusive layer are also useful to minimize secondary exposure. They have also provided an unanticipated advantage during the manufacturing. When the silver halide emulsion are coated, they contain a large amount of water that needs to be dried or evaporated. The metallic layer provides an radiant heat reflector that aids in drying and the crosslinking of hardener in the gelatin binder. This has significant cost advantages for manufacturing. Furthermore the metallic layer may also provide a barrier to the transmission of gases such as water vapor.

An additional embodiment of this invention comprises a photographic element in which there is a second metallic layer on the backside of the support member. A second metallic layer adds additional opacity to assure complete stoppage of light transmission. This further helps to enable very intense, vivid indica on the backside without show through when the image is being viewed. The preferred embodiment is a photographic element that comprises a support member and a metallic layer on the bottom side of the element. That is the metallic layer is on the opposite side of the support from the silver halide emulsion. The location of the metallic layer helps to minimize any diffusive reflection or secondary exposure to the silver halide emulsion. Furthermore the support helps to reduce the dark appearance of the metallic layer when viewing an image. The metallic layer may be an metal that can be vacuum deposited or formed into a thin continuous sheet.

An additional means of forming a multilayer photographic element is to vacuum deposit a thin metallic layer on a biaxially oriented polymer sheet. Such a sheet may comprises a white appearing biaxially oriented polymer sheet that further comprises voids and or pigments. The biaxially oriented sheet may be of any suitable polymer such as polyolefin, polyester, polyaminde. These polymers may be mixed and matched within a multilayer structure to provide additional functional. In particular a metalic polyester or polypropylene sheet that comprises voids may further comprise a layer on polyethylene that enhances adhesion of a photographic emulsion.

The adhesion of a metallic layer to paper or polymer is difficult and therefore the choice of material for adhesion is important to assure proper functionality of the final photographic element. The metallic layer may either be chemically primed to promote adhesion or coated with a heat or pressure sensitive adhesive. These material may be either coated by aqueous or solvent based coaters or an extrudable polymer may be used. Copolymer of polyolefins and polyesters provide good adhesion results. Such polymers may also comprise vinyl groups to provides additional improvements. In the case in which the metallized layer is incorporated with the biaxially oriented sheet of polypropylene, the metallized layer is vacuum deposited on the biaxially oriented sheet. A tie layer of melt polymer or coated adhesive is used to attach said sheet to the paper base. The metal or metallized layer can comprise at least one material from the following list of aluminum, nickel steel gold, zinc, copper, titanium, metallic alloys as well as inorganic compounds such as silicon oxides, silicon nitrides, aluminum oxides or titanium oxides. The preferred material comprises a vacuum deposited layer of aluminum and one or more layers of polyolefin which have been adhered to a paper base with a layer of polyolefin. Aluminum is preferred because of it high reflection qualities, availability and cost. In addition aluminum is currently used in many commercial application and the vacuum coating of this material is well know in the art. The prior art for use of a metallized layer with films of polypropylene and coating of other substances to control water vapor transmission is noted in U.S. Pat. No. 5,192,620. The indicated use is for packaging applications.

The present invention consists of a multilayer sheet of biaxially oriented polyolefin which is attached to both the top and bottom of a photographic quality paper support by melt extrusion of a polymer tie layer. The terms as used herein, "top", "upper", "emulsion side", and "face" mean the side or towards the side of an imaging member bearing the imaging layers. The terms "bottom", "lower side", and "back" mean the side or towards the side of the imaging member opposite from the side bearing the imaging layers or developed image. The term "tie layer" as used herein refers to a layer of material that is used to adhere a biaxially oriented sheets to a base such as paper, polyester, fabric, or other suitable material for the viewing of images.

The present invention consists of a multilayer sheet of biaxially oriented polyolefin which is attached to both the top and bottom of a photographic quality paper support by melt extrusion of a polymer tie layer. The terms as used herein, "top", "upper", "emulsion side", and "face" mean the side or towards the side of an imaging member bearing the imaging layers. The terms "bottom", "lower side", and "back" mean the side or towards the side of the imaging member opposite from the side bearing the imaging layers or developed image. The term "tie layer" as used herein refers to a layer of material that is used to adhere a biaxially oriented sheets to a base such as paper, polyester, fabric, or other suitable material for the viewing of images.

Any suitable biaxially oriented polyolefin sheet may be used for the sheet on the top side of the laminated base used in the invention. Microvoided composite biaxially oriented sheets are preferred and are conveniently manufactured by coextrusion of the core and surface layers, followed by bially orientation, whereby voids are formed around void-initiating material contained in the core layer. Such composite sheets may be formed as in U.S. Pat. Nos. 4,377,616; 4,758,462; and 4,632,869.

The core of the preferred composite sheet should be from 15 to 95% of the total thickness of the sheet, preferably from 30 to 85% of the total thickness. The nonvoided skin(s) should thus be from 5 to 85% of the sheet, preferably from 15 to 70% of the thickness.

The density (specific gravity) of the composite sheet, expressed in terms of "percent of solid density" is calculated as follows:

$$\text{Composite Sheet Density} \times 100 = \%\ \text{of Solid Density}$$

Polymer Density

Percent solid density should be between 45% and 100%, preferably between 67% and 100%. As the percent solid density becomes less than 67%, the composite sheet becomes less manufacturable due to a drop in tensile strength and it becomes more susceptible to physical damage.

The total thickness of the composite sheet can range from 12 to 100 $\mu$m, preferably from 20 to 70 $\mu$m. Below 20 $\mu$m, the microvoided sheets may not be thick enough to minimize any inherent non-planarity in the support and would be more difficult to manufacture. At thickness higher than 70 $\mu$m, little improvement in either surface smoothness or mechanical properties are seen, and so there is little justification for the further increase in cost for extra materials.

The biaxially oriented sheets that have been used in this invention may contain a plurality of layers in which at least one of the layers contains voids. The voids provide added opacity to the imaging element. This voided layer can also be used in conjunction with a layer that contains at least one pigment from the group consisting of: $TiO_2$, $CaCO_3$, clay, $BaSO_4$, ZnS, $MgCO_3$, talc, kaolin, or other materials that provide a highly reflective white layer in said film of more than one layer. The combination of a pigmented layer with a voided layer provides additional advantages in the optical performance of the final imaging element. The imaging element may have either a photographic silver halide and dye forming coupler emulsion or an image receiving layer typically used for thermal dye sublimation or ink jet. "Void" is used herein to mean devoid of added solid and liquid matter, although it is likely the "voids" contain gas. The void-initiating particles which remain in the finished packaging sheet core should be from 0.1 to 10 $\mu$m in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

The void-initiating material may be selected from a variety of materials, and should be present in an amount of about 5 to 50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula $Ar—C(R)=CH_2$, wherein Ar represents an aromatic hydrocarbon radical, or an aromatic halohydrocarbon radical of the benzene series and R is hydrogen or the methyl radical; acrylate-type monomers include monomers of the formula $CH_2=C(R')—C(O)(OR)$ wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2{=}CH(O)COR$, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefnic linkages within the polymer molecule, the above described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate and mixtures thereof.

Examples of typical monomers for making the crosslinked polymer include styrene, butyl acrylate, acrylanide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethyl-propane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening the beads spanning the range of the original distribution of sizes. Other processes such as suspension polymerization, limited coalescence, directly yield very uniformly sized particles.

The void-initiating materials may be coated with agents to facilitate voiding. Suitable agents or lubricants include colloidal silica, colloidal alumina, and metal oxides such as tin oxide and aluminum oxide. The preferred agents are colloidal silica and alumina, most preferably, silica. The cross-linked polymer having a coating of an agent may be prepared by procedures well known in the art. For example, conventional suspension polymerization processes wherein the agent is added to the suspension is preferred. As the agent, colloidal silica is preferred.

The void-initiating particles can also be inorganic spheres, including solid or hollow glass spheres, metal or ceramic beads or inorganic particles such as clay, talc, barium sulfate, calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin sheet is utilized.

For the biaxially oriented sheet on the top side toward the emulsion, suitable classes of thermoplastic polymers for the biaxially oriented sheet and the core matrix-polymer of the preferred composite sheet comprise polyolefins.

Suitable polyolefins include polypropylene, polyethylene, polymethylpentene, polystyrene, polybutylene and mixtures thereof. Polyolefin copolymers, including copolymers of propylene and ethylene with olefins such as hexene, butene, and octene are also useful Polypropylene is preferred, as it is low in cost and has desirable strength properties.

The nonvoided skin layers of the composite sheet can be made of the same polymeric materials as listed above for the core matrix. The composite sheet can be made with skin(s) of the same polymeric material as the core matrix, or it can be made with skin(s) of different polymeric composition than the core matrix. For compatibility, an auxiliary layer can be used to promote adhesion of the skin layer to the core.

Addenda may be added to the core matrix and/or to the skins to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet. For photographic use, a white base with a slight bluish tint is preferred.

The biaxially oriented polyolefin sheet contains a stabilizing amount of hindered amine at or about 0.01 to 5% by weight in at least one layer of said sheet. While these levels provide improved stability to the biaxially oriented sheet, the preferred amount at or about 0.1 to 3% by weight provides an excellent balance between improved stability for both light and dark keeping while making the structure more cost effective.

The hindered amine stabilizer may come from the common group of hindered amine light stabilizers originating from 2,2,6,6-tetramethylpiperidine, and the term hindered amine light stabilizer is accepted to be used for hindered piperidine analogues.

The coextrusion, quenching, orienting, and heat setting of these composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature, below the melting temperature of the matrix polymers. The sheet may be stretched in one direction and then in a second direction or may be simultaneously stretched in both directions. After the sheet has been stretched, it is heat set by heating to a temperature sufficient to crystallize or anneal the polymers while restraining to some degree the sheet against retraction in both directions of stretching.

The composite sheet, while described as having preferably at least three layers of a microvoided core and a skin layer on each side, may also be provided with additional layers that may serve to change the properties of the biaxially oriented sheet. A different effect may be achieved by additional layers. Such layers might contain tints, antistatic materials, or different void-making materials to produce sheets of unique properties. Biaxially oriented sheets could be formed with surface layers that would provide an improved adhesion, or look to the support and photographic element. The biaxially oriented extrusion could be carried out with as many as 10 or more layers if desired to achieve some particular desired property.

These composite sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability, coating polyvinylidene chloride for heat seal properties. Further examples include flame, plasma or corona discharge treatment to improve printability or adhesion.

By having at least one nonvoided skin on the microvoided core, the tensile strength of the sheet is increased and makes it more manufacturable. It allows the sheets to be made at wider widths and higher draw ratios than when sheets are made with all layers voided. Coextruding the layers further simplifies the manufacturing process.

The structure of a preferred biaxially oriented top sheet where the photographic imaging layers are coated on the polyethylene layer is a follows:

| |
|---|
| Polyethylene with blue tint |
| Polypropylene with optical brightener and 24% anatase $TiO_2$ |
| Voided polypropylene |
| Polypropylene with 6% rutile $TiO_2$ |

The sheet on the side of the base paper opposite to the emulsion layers may be any suitable sheet. The sheet may or may not be microvoided. It may have the same composition as the sheet on the top side of the paper backing material Biaxially oriented sheets are conveniently manufactured by coextrusion of the sheet, which may contain several layers, followed by biaxial orientation. Such biaxially oriented sheets are disclosed in, for example, U.S. Pat. No. 4,764,425, the disclosure of which is incorporated for reference.

The preferred biaxially oriented sheet is a biaxially oriented polyolefin sheet, most preferably a sheet of polyethylene or polypropylene. The thickness of the biaxially oriented sheet should be from 10 to 150 $\mu$m. Below 15 $\mu$m, the sheets may not be thick enough to minimize any inherent non-planarity in the support and would be more difficult to manufacture. At thicknesses higher than 70 $\mu$m, little improvement in either surface smoothness or mechanical properties are seen, and so there is little justification for the further increase in cost for extra materials.

Suitable classes of thermoplastic polymers for the biaxially oriented sheet include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Suitable polyolefins include polypropylene, polyethylene, polymethylpentene, and mixtures thereof. Polyolefin copolymers, including copolymers of propylene and ethylene such as hexene, butene and octene are also useful. Polypropylenes are preferred because they are low in cost and have good strength and surface properties.

Suitable polyesters include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol propylene glycol, butanediol, pentanediol, hexanediol, 1,4-cyclohexanedimethanol, diethylene glycol, other polyethylene glycols and mixtures thereof. Such polyesters are well known in the art and may be produced by well known techniques, e.g., those described in U.S. Pat. Nos. 2,465,319 and 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607, 4,459,402 and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

The biaxially oriented sheet on the back side of the laminated base can be made with layers of the same polymeric material, or it can be made with layers of different polymeric composition. For compatibility, an auxiliary layer can be used to promote adhesion of multiple layers.

Addenda may be added to the biaxially oriented back side sheet to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet.

The biaxially oriented sheet on the back side of the laminated base, while described as having preferably at least one layer, may also be provided with additional layers that may serve to change the properties of the biaxially oriented sheet. A different effect may be achieved by additional layers. Such layers might contain tints, antistatic materials, or slip agents to produce sheets of unique properties. Biaxially oriented sheets could be formed with surface layers that would provide an improved adhesion, or look to the support and photographic element. The biaxially oriented extrusion could be carried out with as many as 10 layers if desired to achieve some particular desired property.

These biaxially oriented sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability, coating polyvinylidene chloride for heat seal properties. Further examples include flame, plasma or corona discharge treatment to improve printability or adhesion.

The structure of a preferred biaxially oriented sheet polyolefin sheet that may be laminated to the bottom side of the base with the core layer towards the top is as follows:

| |
|---|
| Polyethylene |
| Polyester core |

The support to which the microvoided composite sheets and biaxially oriented sheets are laminated for the laminated support of the photosensitive silver halide layer may be a polymeric, a synthetic paper, cloth, woven polymer fibers, or a cellulose fiber paper support, or laminates thereof. The base also may be a microvoided polyethylene terephthalate such as disclosed in U.S. Pat. Nos. 4,912,333; 4,994,312 and 5,055,371.

The preferred support is a photographic grade cellulose fiber paper. When using a cellulose fiber paper support, it is preferable to extrusion laminate the microvoided composite sheets to the base paper using a polyolefin resin. Extrusion laminating is carried out by bringing together the biaxially oriented sheets of the invention and the base paper with application of an adhesive between them followed by their being pressed in a nip such as between two rollers. The adhesive may be applied to either the biaxlally oriented sheets or the base paper prior to their being brought into the nip. In a preferred form the adhesive is applied into the nip simultaneously with the biaxially oriented sheets and the base paper. The adhesive may be any suitable material that does not have a harmful effect upon the photographic element. A preferred material is polyethylene that is melted at the time it is placed into the nip between the paper and the biaxially oriented sheet.

During the lamination process, it is desirable to maintain control of the tension of the biaxially oriented sheets in order to minimize curl in the resulting laminated support. For high humidity applications (>50% RH) and low humidity applications (<20% RH), it is desirable to laminate both a front side and back side film to keep curl to a minimum.

As used herein the phrase "imaging element" is a material that may be used as a laminated support for the transfer of images to the support by techniques such as ink jet printing or thermal dye transfer as well as a support for silver halide images. As used herein, the phrase "photographic element" is a material that utilizes photosensitive silver halide in the formation of images. In the case of thermal dye transfer or ink jet, the image layer that is coated on the imaging element may be any material that is known in the art such as gelatin, pigmented latex, polyvinyl alcohol polycarbonate, polyvinyl pyrrolidone, starch and methacrylate. The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The silver halide emulsions utilized in this invention may be comprised of any halide distribution. Thus, they may be comprised of silver chloride, silver chloroiodide, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory of the Photographic Process*, Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectralchemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23,113 (1979). Examples of processes for preparing intentionally reduction sensitized silver halide emulsions are described in EP 0 348934 A1 (Yamashita), EP 0 369491 (Yamashita), EP 0 371388 (Ohashi), EP 0 396424 A1 (Takada), EP 0 404142 Al (Yamada), and EP 0 435355 A1 (Makino).

The photographic elements of this invention may use emulsions doped with Group VIII metals such as iridium, rhodium, osmium, and iron as described in Research Disclosure, September 1996, Item 38957, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography AnnuaL 1982, pages 201–203.

A typical multicolor photographic element of the invention comprises the invention Inminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black and white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 $\mu$m.

In the following Table, reference will be made to (1) Research Disclosure, December 1978, Item 17643, (2) Research Disclosure, December 1989, Item 308119, and (3) Research Disclosure, September 1996, Item 38957, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| 3 | I, II, III, IX A & B | hardeners, coating aids, addenda, etc. |
| 1 | III, IV | Chemical sensitization and |
| 2 | III, IV | spectral sensitization/ |
| 3 | IV, V | desensitization |
| 1 | V | UV dyes, optical |
| 2 | V | brighteners, luminescent |
| 3 | VI | dyes |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; matting agents |
| 3 | VIII, IX C & D | |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be exposed with various forms of energy which encompass the ultraviolet, visible, and infrared regions of the electromagnatic spectrum as well as with electron beam, beta radiation, gamma radiation, x-ray, alpha particle, neutron radiation, and other forms of corpuscular and wave-like energy in either noncoherent (random phase) forms or coherent (in phrawse) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4™ (Eastman Kodak Company) Process or other processing systems suitable for developing high chloride emulsions.

The laminated substrate of the invention may have copy restriction features incorporated such as disclosed in U.S. application Ser. No. 08/598,785 filed Feb. 8, 1996 and U.S. application Ser. No. 08/598,778 filed on the same day. These applications disclose rendering a document copy restrictive by embedding into the document a pattern of invisible microdots. These microdots are, however, detectable by the electro-optical scanning device of a digital document copier. The pattern of microdots may be incorporated throughout the document. Such documents may also have colored edges or an invisible microdot pattern on the back side to enable users or machines to read and identify the media. The media may take the form of sheets that are capable of bearing an image. Typical of such materials are photographic paper and film materials composed of polyethylene resin coated paper, polyester, (poly)ethylene naphthalate, and cellulose triacetate based materials.

The microdots can take any regular or irregular shape with a size smaller than the maximum size at which individual microdots are perceived sufficiently to decrease the usefulness of the image, and the minimum level is defined by the detection level of the scanning device. The microdots may be distributed in a regular or irregular array with center-to-center spacing controlled to avoid increases in document density. The microdots can be of any hue, brightness, and saturation that does not lead to sufficient detection by casual observation, but preferably of a hue least resolvable by the human eye, yet suitable to conform to the sensitivities of the document scanning device for optimal detection.

In one embodiment the information-bearing document is comprised of a support, an image-forming layer coated on the support and pattern of microdots positioned between the support and the image-forming layer to provide a copy restrictive medium. Incorporation of the microdot pattern into the document medium can be achieved by various printing technologies either before or after production of the original document. The microdots can be composed of any colored substance, although depending on the nature of the document, the colorants may be translucent, transparent, or opaque. It is preferred to locate the microdot pattern on the support layer prior to application of the protective layer, unless the protective layer contains light scattering pigments. Then the microdots should be located above such layers and preferably coated with a protective layer. The microdots can be composed of colorants chosen from image dyes and filter dyes known in the photographic art and dispersed in a binder or carrier used for printing inks or light-sensitive media.

In a preferred embodiment the creation of the microdot pattern as a latent image is possible through appropriate temporal spatial and spectral exposure of the photosensitive materials to visible or non-visible wavelengths of electromagnetic radiation. The latent image microdot pattern can be rendered detectable by employing standard photographic chemical processing. The nmicrodots are particularly useful for both color and black-and-white image-forming photographic media. Such photographic media will contain at least one silver halide radiation sensitive layer, although typically such photographic media contain at least three silver halide radiation sensitive layers. It is also possible that such media contain more than one layer sensitive to the same region of radiation. The arrangement of the layers may take any of the forms known to one skilled in the art, as discussed in Research Disclosure 37038 of February 1995.

The following examples illustrate the practice of this invention.

They are not intended to be exhaustive of all possible variations of the invention. Parts and percentages are by weight unless otherwise indicated.

EXAMPLES

Coating format 1 below was used as the photographic imaging layer in the examples below:

| | Coating Format 1 | Laydown mg/m$^2$ |
|---|---|---|
| Layer 1 | Blue Sensitive Layer | |
| | Gelatin | 1300 |
| | Blue sensitive silver | 200 |
| | Y-1 | 440 |
| | ST-1 | 440 |
| | S-1 | 190 |
| Layer 2 | Interlayer | |
| | Gelatin | 650 |
| | SC-1 | 55 |
| | S-1 | 160 |
| Layer 3 | Green Sensitive | |
| | Gelatin | 1100 |
| | Green sensitive silver | 70 |
| | M-1 | 270 |
| | S-1 | 75 |
| | S-2 | 32 |
| | ST-2 | 20 |
| | ST-3 | 165 |
| | ST-4 | 530 |
| Layer 4 | UV Interlayer | |
| | Gelatin | 635 |
| | UV-1 | 30 |
| | UV-2 | 160 |
| | SC-1 | 50 |
| | S-3 | 30 |
| | S-1 | 30 |
| Layer 5 | Red Sensitive Layer | |
| | Gelatin | 1200 |
| | Red sensitive silver | 170 |
| | C-1 | 365 |
| | S-1 | 360 |
| | UV-2 | 235 |
| | S-4 | 30 |
| | SC-1 | 3 |
| Layer 6 | UV Overcoat | |
| | Gelatin | 440 |
| | UV-1 | 20 |
| | UV-2 | 110 |
| | SC-1 | 30 |
| | S-3 | 20 |
| | S-1 | 20 |
| Layer 7 | SOC | |
| | Gelatin | 490 |
| | SC-1 | 17 |
| | $SiO_2$ | 200 |
| | Surfactant | 2 |

APPENDIX

Y-1

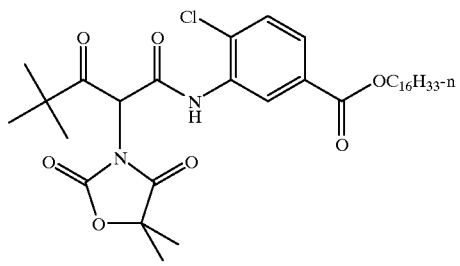

ST-1 = N-tert-butylacrylamide/n-butyl acrylate copolymer (50:50)

S–1 = dibutyl phthalate

SC-1

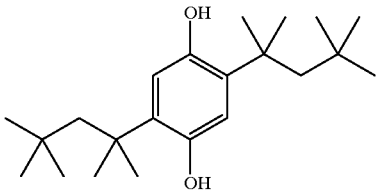

M-1

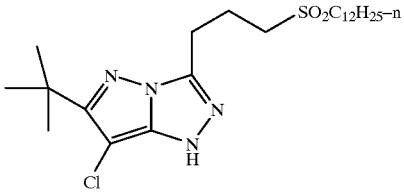

S–2 = diundecyl phthalate

ST–2

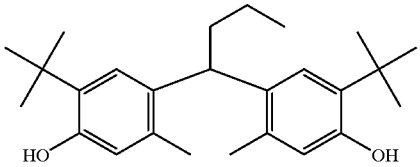

ST–3

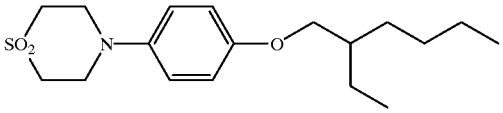

ST–4

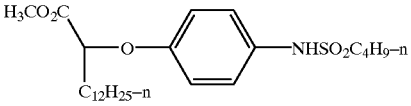

UV–1

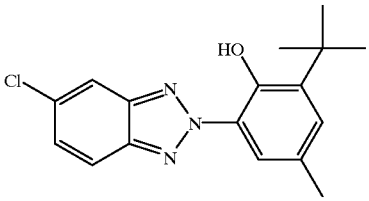

UV–2

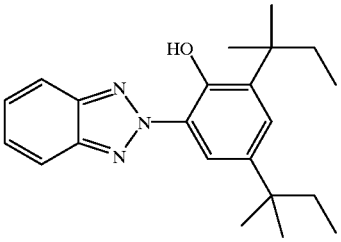

-continued

S–3 = 1,4–Cyclohexyldimethylene bis(2–ethylhexanoate)

C–1

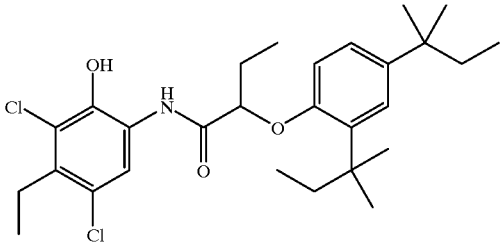

S–4 = 2–(2–Butoxyethoxy)ethyl acetate

Dye 1

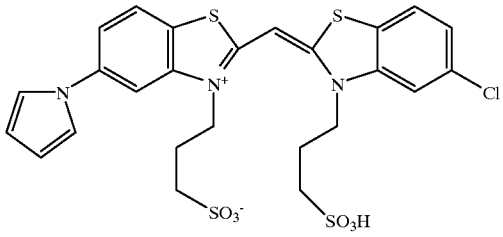

Commercial Grade Paper of Examples

A photographic paper support was produced by refining a pulp furnish of 50% bleached hardwood kraft, 25% bleached hardwood sulfite, and 25% bleached softwood sulfite through a double disk refiner, then a Jordan conical refiner to a Canadian Standard Freeness of 200 cc. To the resulting pulp furnish is added 0.2% alkyl ketene dimer, 1.0% cationic cornstarch, 0.5% polyamide-epichlorohydrin, 0.26 anionic polyacrylamide, and 5.0% $TiO_2$ on a dry weight basis. An about 227g/$m^2$ bone dry weight base paper is made on a fourdrinier paper machine, wet pressed to a solid of 42%, and dried to a moisture of 10% using steam-heated dryers achieving a Sheffield Porosity of 160 Sheffield Units and an apparent density 0.70 g/cc. The paper base is then surface sized using a vertical size press with a 10% hydroxyethylated cornstarch solution to achieve a loading of 3.3 wt. % starch. The surface sized support is calendered to an apparent density of 1.04 $\mu$m/cc.

Example 1

Bottom Sheet: (Backside)

BICOR 70 MLT (Mobil Chemical Co.), a one-side matte finish, one-side treated biaxially oriented polypropylene sheet (18 micrometer thick, density of 0.9 g/cc) consisting of a solid oriented polypropylene core and a skin layer of a mixture of polyethylene and a terpolymer of ethylene-propylene-butylene with a orientation ratio of 5:8. Polypropylene core side was laminated to the cellulose paper exposing the skin layer of block copolymer. The backside sheet was prepared by melt extrusion lamination using 1924P low density polyethylene (Eastman Chemical Co.) (extrusion grade with a density of 0.923 g/$cm^3$ and a melt index of 4.2) as the bonding layer.

The following sheets were then laminated to the face side (image side) of the photographic grade cellulose paper base creating a white imaging base.

Top Side: (Image Side)

A bixially oriented polypropylene film of 1.5 mils thickness containing a thin skin layer of polyethylene to improve the adhesion of the emulsion to the film sheet, a layer of polypropylene that contains a 18% $TiO_2$ (L2), a voided core of polypropylene ( L3) and a solid layer of a homopolymer of polypropylene. On the bottom side of this sheet is vacuum deposited layer of aluminum. The layer of aluminum is of sufficient thickness to provide a highly reflective surface. Said metallized sheet is attached to the paper base with a tie layer blend of 50% Eastman Chemical 4002P an 50% ethylene copolymer of Bynel resin manufactured by Dupont. This blend was coated at a coverage of 12 g/m$^2$.

Example 2 and 3

Other examples were prepared by vacuum depositing a layer of aluminum on a sheets of polyester which were 3.8 mils thick 7 mils thick. The layer of aluminum was of sufficient thickness to provide a very high level of gloss. On the side opposite of the metallized layer, the polyester sheet was subbed with a layer comprising gelatin. The above base was extrusion laminated to a second base of polyester to add stiffness to the entire package as well as to provide some protection to the metallied layer. The imaging element was prepared by coating a standard silver halide photographic emulsion onto a clear polyester base as shown in the diagram below. Said imaging element was exposed and processed and dried. The two separate elements then were fused together using a hot pressure roll laminator.

The structure of Example 2 (3.8 mil clear layer) & 3 (7 mil clear layer) was as follows: Image

| |
|---|
| Image |
| Gel Sub |
| Clear polyester (3.8 and 7 Mils) |
| Vacuum aluminum |
| Tie Layer of Bynel |
| Polyester Base |

Control

The control sample was a standard photographic print comprising a commercially grade of photographic paper with 25.5 g/m$^2$ of a pigmented polyethylene directly under the image layer and 25 g/m$^2$ of a clear polyethylene on the backside.

Results

The above examples were evaluated for relative depth of image.

This was done by assessing the visual appeal on a 1–10 scale. One being a standard photographic print and 10 being a mirror.

TABLE 1

| Example | Description | Depth Assessment |
|---|---|---|
| 1 | Integral with paper | 2–3 |
| 2 | 3.8 mils clear spacer | 6 |
| 3 | 7 mil clear spacer | 8 |
| 4 | Std Control | 1 |

The depth assessment was a subjective rating of the mirror like quality of the image. Since all samples were better than the control, the control sample was assigned a value of 1. A 10 is considered to be a highly polished glass mirror. A relative rating was assigned to the other samples.

In a separate evaluation the opacity of samples with a metallic layer were evaluated as compared to a standard photographic print element. All samples were coated with a light sensitive silver halide emulsion as shown by coating format 1. The samples were processed with minimum density.

Sample A: Standard photographic print element.

The control sample was a standard photographic print comprising a commercially grade of photographic paper with 25.5 g/m$^2$ of a pigmented polyethylene directly under the image layer and 25 g/m$^2$ of a clear polyethylene on the backside.

Samle B,C,&D

This sample utilized a commercial grade of photographic paper with a biaxially oriented sheet of polypropylene that had been metallized by vacuum depositing a layer of aluminum on one side and a cavitated core of voided polypropylene and a clear skin of polypropylene on one side. This a commercially available film by Mobil Chemical. The film was 278 MET-TWSB and it was adhere to the paper base using Dupont Bynel coated at 12 g/m$^2$ and the metallized layer was positioned next to the paper. A backside film of 70MLT which is a matte film manufactured by Mobil Chemical was attached to the backside with a melt extruded tie layer of 60/40 low density polyethylene (Eastman Chemical 4002P) and Exxon SLP 9088. The tie layer was coated at 12. g/m$^2$. On the top side of this structure a coverage series of pigmented polyethylene was run by melt extruding a low density pigmented polyethylene layer that further comprised $TiO_2$ at 12.5 % by weight of that layer. The following coverage were coated on the clear polypropylene side that was on top of the cavitated core.

Sample B: 12 g/m$^2$

Sample C: 25 g/m$^2$

Sample D: 50 g/m$^2$

Sample E:

This sample was prepared by laminating a sheet of 278 MET-TWSB to the backside of a commercial photographic base using a tie layer of Dupont Bynel coated at 12 gm/m$^2$ and the metallized layer was positioned next to the paper. On the opposite side of the paper base, a sheet of biaxially oriented polymer was laminated with an extrusion coated tie layer of pigmented low density polyethylene coated at 12 g/m$^2$. The biaxially oriented sheet was approximately 35.5 micrometers thick and comprised a clear top skin of polyethylene with blue tint at 1 micrometer, a pigmented layer of polypropylene at 7 micrometers at 24% by weight Dupont $TiO_2$, a cavitated voided layer of polypropylene at 20.2 micrometers and a layer of clear polypropylene at 7.3 micrometers.

TABLE 2

Opacity and L* Evaluation

| Sample | Opacity | L* |
|---|---|---|
| A (Control) | 92.3 | 92.1 |
| B | 98.3 | 87.4 |
| C | 99 | 89.6 |
| D | 99.2 | 91.8 |
| E | 100 | 95.5 |

As can be seen from table 2 the use of a metallized layer in an imaging structure has a large effect on the opacity of the sample and furthermore if the metallized layer is positioned below the raw stock, the added effect is to provide complete opacity of the structure. It also should be noted that the lightness of the sample is decreased with the foil layer providing it with a dark appearance. With the addition of $TiO_2$ or other white pigment, the lightness is improved has the total amount of $TiO_2$ is increased. When the metalzed layer is position on the backside and a voided and pigmented sheet of biaxially oriented polypropylene is attached on the opposite side, there is a large improvement in the lightness of the sample.

The invention of this patent has been described in detail with particular reference to certain preferred embodiments thereof, but it will be understood that variations and modifications can be effected within the spirit and scope of the invention.

What is claimed is:

1. A photographic element comprising at least one photosensitive silver halide emulsion layer and a metallic layer between said at least one photosensitive silver halide emulsion layer and a support, wherein there is a transparent polymer layer between said metallic layer and said at least one silver halide emulsion layer and wherein said transparent polymer layer is between 10 and 250 $\mu$m thick, said metallic layer comprises a metal vacuum deposited onto a polymer carrier sheet, and wherein said polymer carrier sheet comprises a biaxially oriented polymer sheet.

2. The photographic element of claim 1 wherein said support comprises a polymer sheet.

3. The photographic element of claim 1 wherein said support comprises a cellulose paper.

4. The photographic element of claim 1 wherein said metallic layer is reflective.

5. The photographic element of claim 4 wherein said metallic layer has a reflectance greater than 85% of the visible spectrum.

6. The photographic element of claim 5 wherein said reflectance is specular.

7. The photographic element of claim 4 wherein there is a pigmented polymer layer between said metallic layer and said support.

8. The photographic element of claim 5 further comprising a second metallic layer on the backside of said support.

9. The photographic element of claim 1 wherein said element further comprises a metallic layer is on the backside of said support.

10. The photographic element of claim 4 wherein said metallic layer comprises at least one material selected from the group consisting of aluminum, nickel, gold, steel, zinc, copper, titanium, and metallic alloys.

11. The photographic element of claim 1 wherein said polymer carrier sheet comprises voids.

12. The photographic element of claim 9 wherein said metallic layer on the front side and the backside of said support comprises at least one material selected from the group consisting, aluminum, nickel, gold, silver, steel, zinc, copper, titanium, and metallic alloys.

13. A photographic element comprising at least one photosensitive silver halide emulsion layer and a metallic layer between said at least one photosensitive silver halide emulsion layer and a support, wherein there is a transparent polymer layer between said metallic layer and said at least one silver halide emulsion layer, wherein said metallic layer has a reflectance greater than 85% of the visible spectrum, and wherein said metallic layer comprises at least one material selected from the group consisting of aluminum, nickel, gold, steel, zinc, copper, titanium, and metallic alloys.

14. The photographic element of claim 13 wherein said support comprises a polymer sheet.

15. The photographic element of claim 13 wherein said metallic layer comprises a metal foil.

16. The photographic element of claim 13 wherein said metallic layer comprises a metal vacuum deposited onto a polymer carrier sheet.

17. The photographic element of claim 13 wherein said support comprises a cellulose paper.

18. The photographic element of claim 13 wherein said transparent polymer layer is between 10 and 250 $\mu$m thick.

19. The photographic element of claim 13 wherein there is a pigmented polymer layer between said metallic layer and said support.

20. The photographic element of claim 13 wherein said reflectance is specular.

21. The photographic element of claim 14 further comprising a second metallic layer on the backside of said support.

22. The photographic element of claim 16 wherein said polymer carrier sheet comprises a biaxially oriented polymer sheet.

23. The photographic element of claim 22 wherein said polymer carrier sheet comprises voids.

24. The photographic element of claim 21 wherein said metallic layer on the backside of said support comprises at least one material selected from the group consisting, aluminum, nickel, gold, silver, steel, zinc, copper, titanium, and metallic alloys.

25. A photographic element comprising at least one photosensitive silver halide emulsion layer and a front side metallic layer between said at least one photosensitive silver halide emulsion layer and a support, wherein there is a transparent polymer layer between said metallic layer and said at least one silver halide emulsion layer, wherein said metallic layer has a reflectance greater than 85% of the visible spectrum, and wherein said metallic layer comprises at least one material selected from the group consisting of aluminum, nickel, gold, steel, zinc, copper, titanium, and metallic alloys and wherein said element further comprises a metallic layer on the backside of said support.

26. The photographic element of claim 25 wherein there is a pigmented polymer layer between said front side metallic layer and said support.

27. The photographic element of claim 25 wherein said metallic layer on the front side and the backside of said support comprises at least one material selected from the group consisting, aluminum, nickel, gold, silver, steel, zinc, copper, titanium, and metallic alloys.

28. The photographic element of claim 25 wherein said support comprises a polymer sheet.

29. The photographic element of claim 25 wherein at least one of said front side and backside metallic layers comprise a metal foil.

30. The photographic element of claim 25 wherein said front side and backside metallic layers comprise a metal vacuum deposited onto a polymer carrier sheet.

31. The photographic element of claim 25 wherein said front side metallic layer is reflective.

32. The photographic element of claim 31 wherein said front side metallic layer has a reflectance greater than 85% of the visible spectrum.

33. The photographic element of claim 26 wherein there is a pigmented polymer layer between said front side metallic layer and said support.

34. The photographic element of claim 25 wherein said front side metallic layer comprises at least one material selected from the group consisting of aluminum, nickel, gold, steel, zinc, copper, titanium, and metallic alloys.

35. The photographic element of claim 34 wherein said transparent polymer layer is between 10 and 250 $\mu$m thick.

36. The photographic element of claim 35 wherein said polymer carrier sheet comprises a biaxially oriented polymer sheet.

37. The photographic element of claim 36 wherein said polymer carrier sheet comprises voids.

38. A photographic element comprising at least one photosensitive silver halide emulsion layer and a metallic layer between said at least one photosensitive silver halide emulsion layer and a support and wherein there is a transparent polymer layer between said metallic layer and said at least one silver halide emulsion layer, wherein said metallic layer has a reflectance greater than 85% of the visible spectrum, and wherein said metallic layer comprises at least one material selected from the group consisting of aluminum, nickel, gold, steel, zinc, copper, titanium, and metallic alloys wherein said polymer carrier sheet comprises a biaxially oriented polymer sheet.

39. The photographic element of claim 38 wherein said transparent polymer layer is between 10 and 250 $\mu$m thick.

40. The photographic element of claim 38 wherein said metallic layers comprise a metal foil.

41. The photographic element of claim 38 wherein said metallic layers comprise a metal vacuum deposited onto a polymer carrier sheet.

42. The photographic element of claim 38 wherein said support comprises a cellulose paper.

43. The photographic element of claim 38 wherein said metallic layer is reflective.

44. The photographic element of claim 43 wherein said metallic layer comprises at least one material selected from the group consisting of aluminum, nickel, gold, steel, zinc, copper, titanium, and metallic alloys.

45. The photographic element of claim 38 wherein said metallic layer has a reflectance greater than 85% of the visible spectrum.

46. The photographic element of claim 45 wherein said reflectance is specular.

47. The photographic element of claim 39 wherein there is a pigmented polymer layer between said metallic layer and said support.

48. The photographic element of claim 38 wherein said element further comprises a metallic layer on the backside of said support.

49. The photographic element of claim 48 further comprising a second metallic layer on the backside of said support.

50. The photographic element of claim 38 wherein said polymer carrier sheet comprises voids.

51. The photographic element of claim 50 wherein there is a pigmented polymer layer between said front side metallic layer and said support.

52. The photographic element of claim 48 wherein said metallic layer on the front side and the backside of said support comprises at least one material selected from the group consisting, aluminum, nickel, gold, silver, steel, zinc, copper, titanium, and metallic alloys.

53. A photographic element comprising at least one photosensitive silver halide emulsion layer and a metallic layer between said at least one photosensitive silver halide emulsion layer and a support, wherein there is a transparent polymer layer between said metallic layer and said at least one silver halide emulsion layer and wherein said transparent polymer layer is between 10 and 250 $\mu$m thick, said metallic layer is reflective, said metallic layer comprises at least one material selected from the group consisting of aluminum, nickel, gold, steel, zinc, copper titanium, and metallic alloys and wherein said metallic layer has a reflectance of greater than 85% of the visible spectrum.

54. The photographic element of claim 53 wherein said support comprises a polymer sheet.

55. The photographic element of claim 53 wherein said metallic layer comprises a metal foil.

56. The photographic element of claim 53 wherein said support comprises a cellulose paper.

57. The photographic element of claim 53 wherein said reflectance is specular.

58. The photographic element of claim 53 wherein there is a pigmented polymer layer between said metallic layer and said support.

59. The photographic element of claim 53 further comprising a second metallic layer on the backside of said support.

* * * * *